US008881741B1

(12) United States Patent
Mattson et al.

(10) Patent No.: US 8,881,741 B1
(45) Date of Patent: Nov. 11, 2014

(54) DEVICES, METHODS, AND SYSTEMS FOR DISPENSING AND APPLYING ARTIFICIAL EYELASH ADHESIVE AND ARTIFICIAL EYELASH STRUCTURES

(71) Applicants: Valerie L. Mattson, Eagle Mountain, UT (US); Gina M. Walker, Highland, UT (US)

(72) Inventors: Valerie L. Mattson, Eagle Mountain, UT (US); Gina M. Walker, Highland, UT (US)

( * ) Notice: Subject to any disclaimer, the term of this patent is extended or adjusted under 35 U.S.C. 154(b) by 33 days.

(21) Appl. No.: 13/724,911

(22) Filed: Dec. 21, 2012

Related U.S. Application Data

(60) Provisional application No. 61/579,239, filed on Dec. 22, 2011.

(51) Int. Cl.
*A41G 5/02* (2006.01)

(52) U.S. Cl.
CPC ..... *A41G 5/02* (2013.01)
USPC ..... 132/201

(58) Field of Classification Search
USPC ..... 132/216, 53, 201, 215; 428/15, 40.1
See application file for complete search history.

(56) References Cited

U.S. PATENT DOCUMENTS

| | | | | |
|---|---|---|---|---|
| 2,835,259 | A * | 5/1958 | Goodman | 132/53 |
| 3,266,500 | A * | 8/1966 | Weld | 132/53 |
| 3,447,542 | A * | 6/1969 | McCullough | 132/53 |
| 3,935,872 | A | 2/1976 | Aylott | |
| 4,511,608 | A * | 4/1985 | Ferraro | 428/15 |
| 6,029,674 | A | 2/2000 | Han | |
| 6,190,747 | B1 * | 2/2001 | Fischer | 428/42.2 |
| 6,308,716 | B1 | 10/2001 | Han | |
| 6,733,856 | B2 * | 5/2004 | Nojiri | 428/40.1 |
| 2002/0162566 | A1 | 11/2002 | Jang | |
| 2003/0232191 | A1 * | 12/2003 | Ishikawa | 428/343 |
| 2005/0061341 | A1 | 3/2005 | Choe | |
| 2006/0144413 | A1 | 7/2006 | Yoneda | |
| 2009/0126753 | A1 | 5/2009 | Sugai et al. | |
| 2010/0043816 | A1 * | 2/2010 | Dix | 132/201 |

OTHER PUBLICATIONS

"Pressure Sensitive Tapes and Labels", http://www.nadco-in.com, Based on information and belief, available at least as early as Oct. 11, 2011 (1 pg).

"Material Safety Data Sheet", 3M, Based on information and belief, available at least as early as Oct. 25, 2011 (7 pgs).

"Champion Tape", http://www.champtiontape.com/products_Specialized.html, Based on information and believe, available at least as early as Oct. 11, 2011 (2 pgs).

* cited by examiner

*Primary Examiner* — Robyn Doan
(74) *Attorney, Agent, or Firm* — Workman Nydegger

(57) ABSTRACT

Devices and systems for dispensing artificial eyelash adhesive for attaching an artificial eyelash to a natural lash line, and to methods of applying artificial eyelashes. Disclosed is an artificial eyelash adhesive dispenser comprising a backing layer, an artificial eyelash adhesive tape layer having a bottom surface adjacent to the backing layer and a peelable protective top layer over the top surface of the eyelash adhesive tape layer. The dispenser further includes a plurality of cuts extending through at least the adhesive tape layer and the peelable protective top layer so as to form a tear line along which an individual strip may be separated from a remainder of the dispenser. The adhesive tape layer is chemically formulated so as to not irritate the skin or eyes. Wig tape is one such material that is particularly suitable.

16 Claims, 7 Drawing Sheets

DEVICES, METHODS, AND SYSTEMS FOR DISPENSING AND APPLYING ARTIFICIAL EYELASH ADHESIVE AND ARTIFICIAL EYELASH STRUCTURES

CROSS REFERENCE TO RELATED APPLICATION

The present application claims the benefit of U.S. Patent Application Ser. No. 61/579,239, filed Dec. 22, 2011 and entitled "DEVICES, METHODS, AND SYSTEMS FOR DISPENSING AND APPLYING ARTIFICIAL EYELASH ADHESIVE AND ARTIFICIAL EYELASH STRUCTURES", the disclosure of which is incorporated by reference in its entirety.

BACKGROUND OF THE INVENTION

1. The Field of the Invention

The present invention relates to devices and systems for dispensing artificial eyelash adhesive for attaching an artificial eyelash to a natural lash line, and to methods of applying artificial eyelashes.

2. The Relevant Technology

Artificial or false eyelashes may be used as a beauty makeup accessory for special occasions, or for patients suffering hair loss effects caused by physical disorders such as alopecia or chemotherapy. False eyelashes are often applied to the natural lash line to accentuate the beauty of the eyes, and are in widespread use as a beauty tool.

Conventional false eyelash structures are typically formed as a single assembly shaped roughly to the natural shape of eyelashes. The eyelash material generally sweeps upwards in a gentle curve from a solid lash line segment. Often this solid lash line segment which serves as an anchor point for the false lashes themselves has a sharp, hard end that is irritating to the sensitive tissues of the inner eyelid. Further, in order to wear the false eyelashes the anchoring solid lash line segment must be attached to the eyelid using an adhesive that may also cause irritation or allergic reaction.

Eyelash adhesives conventionally employed are in liquid form (e.g., dispensed from a tube) and can have unpleasant odors, are difficult to use, and easily irritate (e.g., sting) the eyes. Liquid adhesives are difficult to apply to only the edge of the solid lash line or to the precise edge of an eyelid. Such difficulties often result in adhesive within the individual lashes, or possibly in the eye of the wearer.

Other common difficulties include the partial detachment of the solid lash line segment from the eyelid. Such detachment is not only aesthetically unpleasing, but can result in the sharp end of the solid lash line segment jabbing and stabbing the sensitive skin of the inner eyelid area. The field would benefit from a convenient and efficient device or system for dispensing eyelash adhesive that will not irritate the eyes, and a method of applying such an adhesive to an eyelid and false eyelash that could be secure, physically comfortable, and chemically non-irritating.

BRIEF SUMMARY

Embodiments of the present invention are directed to artificial eyelash adhesive structures, dispensers, and related methods. The structures, dispensers and methods reduce or eliminate incidence of false eyelash dropping, lifting, skin irritation from use of current artificial eyelash adhesives, poking of adhesive structures into adjacent eyelid tissues, and elimination of use of separate liquid glue tubes or other containers/dispensers. The structures, dispensers and methods also facilitate more rapid and easier application, which up to now has been slow and difficult. In addition, existing methods of applying liquid adhesive to adhere artificial eyelash structures often lead to damage to the artificial eyelash structure as adhesive residue builds up after repeated use.

The present inventive structures, dispensers and methods provide easier and faster application, prolong artificial eyelash structure life, prevent drooping or lifting, cause no skin irritation, and remain comfortable when worn for long periods of time. The structures and adhesive employed may be water resistant (still works even if it gets wet), will not disturb real eyelashes, and is easily removed. With the present structures, dispensers and methods, there is no fear of getting adhesive into the eyes. The adhesive layer that is placed may be transparent or translucent, blending with the user's skin color.

Such a dispenser may include a backing layer having a longitudinal axis, an artificial eyelash adhesive tape layer having a bottom surface adjacent to the backing layer and also having an opposing top surface. A peelable protective top layer may be provided over the top surface of the false eyelash adhesive tape layer. At least the adhesive tape layer and the peelable protective top layer may include a plurality of cuts extending a portion of a width of the dispenser in a direction oriented generally transverse to the longitudinal axis of the backing layer so as to form a tear line along which an individual strip including at least a portion of the adhesive tape layer and a portion of the peelable protective top layer may be separated from a remainder of the dispenser.

In another embodiment, artificial eyelash adhesive structures may be provided individually, separate from one another. Such an artificial eyelash adhesive structure may similarly include a backing layer having a longitudinal axis, an artificial eyelash adhesive tape layer having a bottom surface adjacent to the backing layer and also having an opposing top surface. A peelable protective top layer may be provided over the top surface of the false eyelash adhesive tape layer. Where the artificial eyelash adhesive structures are already individualized, separate from one another, the plurality of cuts forming a tear line along which an individual strip may be separated may not be present. Such individual artificial eyelash adhesive structures may include a kiss cut through the top layer, but not into the adhesive tape layer to facilitate removal of the top layer. In addition, such individual artificial eyelash adhesive structures may be configured with one of the backing layer or top layer being longer than the other (e.g., the top layer being shorter than the backing layer or vice versa) so as to further facilitate gripping of an edge of the top layer for its removal.

Related methods of applying an artificial eyelash adhesive tape layer and artificial eyelash structure to a natural lash line of a person are also provided. For example, an artificial eyelash adhesive structure or dispenser as described above may be provided, one may separate an individual strip comprising a portion of at least the artificial eyelash adhesive tape layer and a portion of the peelable top layer from the dispenser (where the artificial eyelash adhesive structure is not already provided individualized). The user may expose the bottom surface of the adhesive tape layer of the strip and apply the bottom surface of the adhesive tape layer of the strip to skin adjacent to a natural lash line. The protective top layer may be peeled away, and an artificial eyelash structure may be applied to an exposed top surface of the strip.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
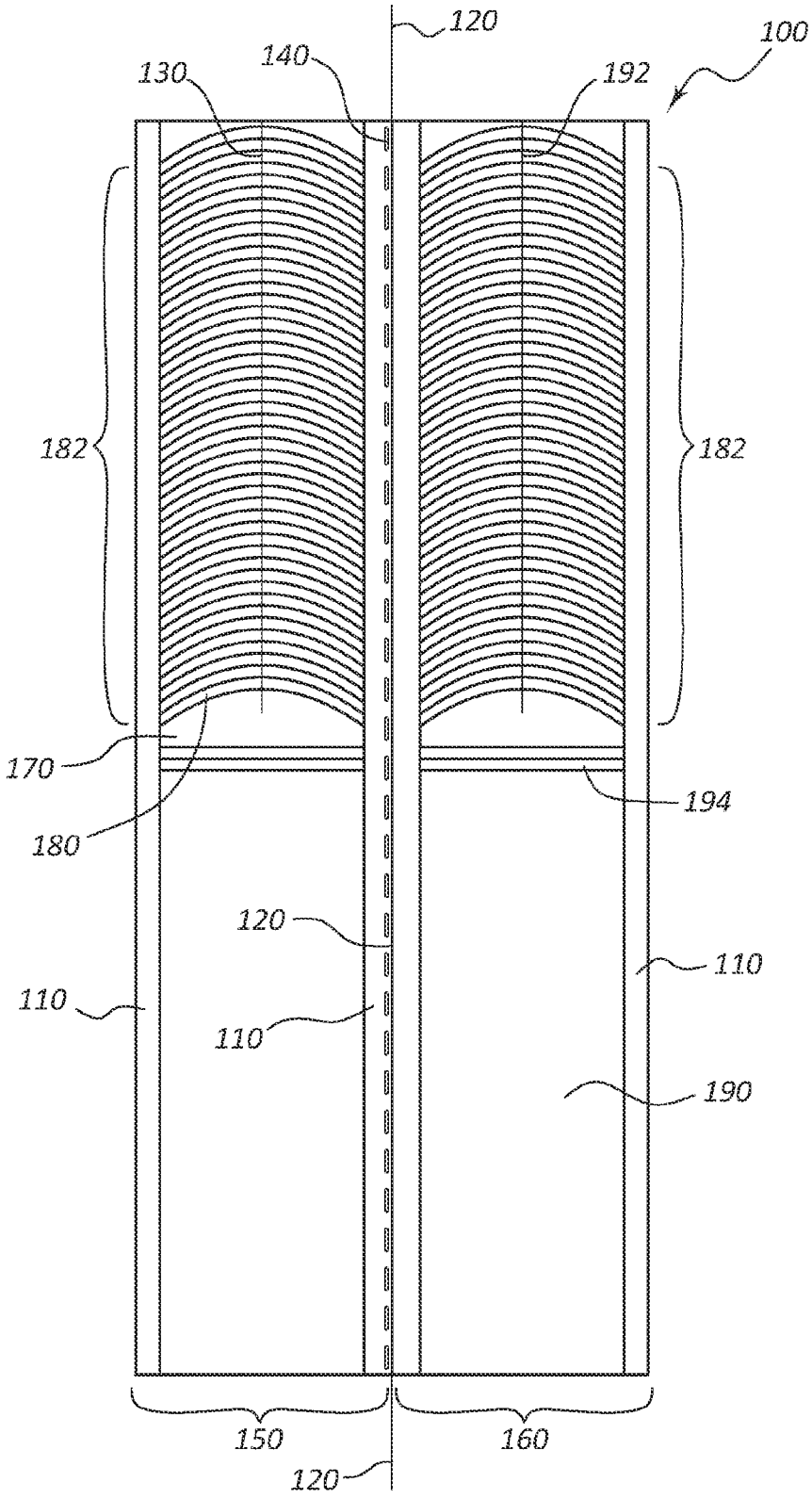
FIG. 1 is a top view of an exemplary artificial eyelash adhesive dispenser according to the present invention.

In an embodiment, the present invention is directed to devices and systems for dispensing artificial eyelash adhesive for attaching an artificial eyelash to a natural lash line, and to methods of applying artificial eyelashes. Disclosed is an artificial eyelash adhesive dispenser comprising a backing layer, an artificial eyelash adhesive tape layer having a bottom surface adjacent to the backing layer, and a peelable protective top layer over the top surface of the eyelash adhesive tape layer. The dispenser further includes a plurality of cuts extending through at least the adhesive tape layer and the peelable protective top layer so as to form a tear line along which an individual strip may be separated from a remainder of the dispenser. In one embodiment, the cuts may also extend through the backing layer. Where the cuts extend through the backing layer, the adhesive tape layer, and the protective top layer, this results in the ability to tear individual tri-layer strips from the dispenser. Where the cuts do not extend through the backing layer, the backing layer stays with the remainder of the dispenser when a bi-layer strip is removed from the dispenser, which simultaneously exposes the bottom surface of the tape layer for placement on the person's lash line.

The adhesive tape layer is advantageously chemically formulated so as to not irritate the skin or eyes. Adhesive materials traditionally used in attaching artificial eyelashes are harsh, and tend to irritate the sensitive tissues on and around the eyelid and eyes. One material that has been identified by the inventors to be particularly well suited for use as the adhesive tape layer is wig tape adhesives. Such adhesives are specifically formulated for placement onto the skin. One suitable wig tape adhesive is acrylic based. In addition, the adhesive tape layer advantageously does not include any relatively rigid structure, but is rather very flexible and soft (i.e., its elongate end will not "poke" the user's eyelid).

Existing adhesives used for adhering false eyelashes are irritating. For example, many users will not wear the eyelashes (and adhesive) for more than an hour or two, because it stings the eyes, irritates the skin, and/or physically pokes the skin. Such systems are simply unsuitable for those (e.g., chemotherapy patients, those with alopecia) who have no natural eyelashes and wish to wear eyelashes for extended periods of time (e.g., all day, every day). For example, such wig adhesives may not cause any rash or other irritation even when contacted with skin for 4 hours, 8 hours, 12 hours, 24 hours, or more.

The present inventive adhesive devices and systems allows one to wear such eyelashes for as long as desired, with no significant irritation to the skin or eyes. Thus, one may easily wear the eyelashes during the day, taking them off at night, or even wear them all day, every day for a period of several days, until it is necessary to replace the adhesive tape, the artificial eyelash structure, or both.

Another embodiment of the present invention is directed to a method of applying an artificial eyelash adhesive tape layer and an artificial eyelash to skin adjacent to a natural lash line of an eyelid. The method includes providing an artificial eyelash adhesive tape dispenser as described above, separating an individual bi-layer or tri-layer strip from the dispenser, exposing the bottom surface of the adhesive tape layer of the strip, and applying the bottom adhesive surface of the strip to skin adjacent to a natural lash line. The protective top layer may then be peeled from the strip, and an artificial eyelash structure may be applied to an exposed adhesive top surface of the tape layer.

Another embodiment is directed to an associated artificial eyelash and adhesive system including one or more artificial eyelash structures, and an artificial eyelash adhesive dispenser as described above. For example, such a system may be provided as a convenient pocket compact, including a tray providing storage for several artificial eyelash structures and an artificial eyelash adhesive dispenser. The tray may be hingedly attached to the compact, which may also conveniently contain a small personal mirror.

The devices, methods and systems of the present invention advantageously allow a person to conveniently and efficiently dispense an eyelash adhesive that will not irritate the eyes. Furthermore, the method of applying such an adhesive and false eyelash structure to an eyelid results in an eyelash structure that is secure, physically comfortable, and chemically non-irritating.

FIG. 1 illustrates an embodiment of an artificial eyelash adhesive dispenser 100. The artificial eyelash dispenser 100 may include a backing layer 110 having a longitudinal axis 120. An adhesive tape layer 170 is sandwiched between backing layer 110 and a protective top layer 190. The backing layer 110, the protective top layer 190, or both may include a kiss cut 130 which extends generally parallel to the longitudinal axis 120 and through a thickness of the backing layer 110, a thickness of protective top layer 190, or both. The kiss cut 130 advantageously does not extend into the adhesive tape layer 170. The backing layer 110, protective top layer 190, or both may also have a perforated gutter 140 also extending generally parallel to the longitudinal axis 120 allowing for easy separation of two columns 150 and 160 of adhesive tape strips 180. A layer of an artificial eyelash adhesive tape 170 includes a bottom surface adjacent to the backing layer 110. The adhesive tape layer 170 may be fabricated using a double stick low allergic acrylic medical adhesive containing a nonwoven carrier as is commercially available. One suitable material is 3M high tack differential double coated nonwoven tissue tape 97048, available from 3M, located in St. Paul, Minn. Various wig tape materials available from Champion or Nadco, located in Sturtevant, Wis. and Sarasota Fla., respectively, are particularly suitable for use. The width of individual strips 180 and 182 of adhesive tape layer 170 may be partially cut along width of strip 180 to facilitate removal of a single strip 180 from a plurality of strips 182 when desired. For example, the cuts may be discontinuous along the width of strip 180 (i.e., leaving a small distance uncut), so that each of strips 182 remain attached to their immediately adjacent strips, but so that removal of an individual strip is easily achieved by pulling a desired strip away from its adjacent neighboring strips.

Figures 2, 2A:
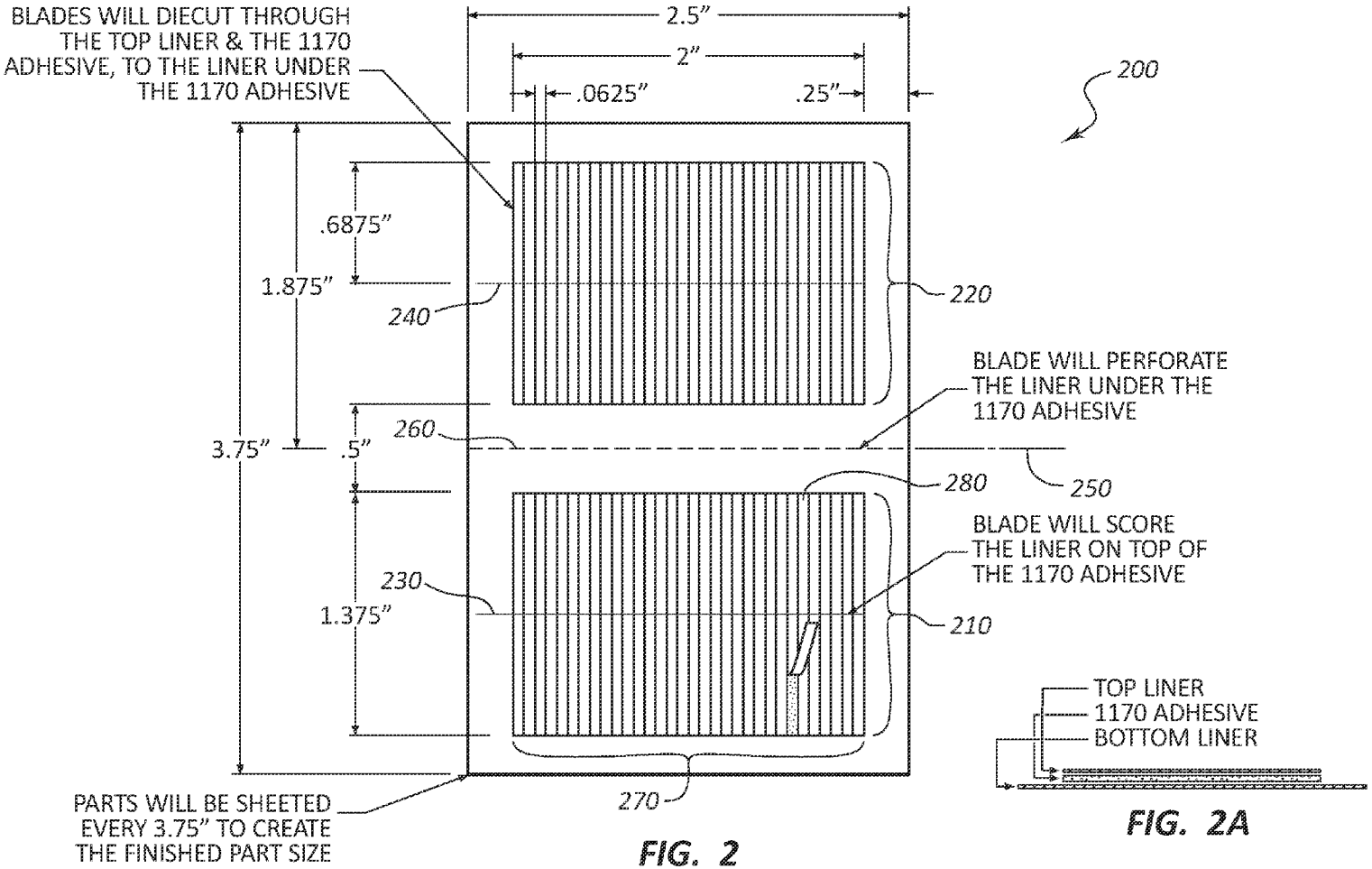
FIG. 2 illustrates another embodiment of an artificial eyelash adhesive dispenser exhibiting two columns of adhesive tape strips, each divided in half by a kiss cut.
FIG. 2A illustrates a cross-sectional or end view of the artificial eyelash adhesive dispenser shown in FIG. 2.

Although FIG. 1 shows the adhesive tape strips 180 as curved shaped, they may be of any shape configured to adhere an artificial eyelash, such as rectangular, other polygonal, crescent shaped, or the like, to skin adjacent to a natural lash line. FIG. 2 shows rectangular shaped strips. A peelable protective top layer 190 may overlay the adhesive tape layer 170. The peelable protective top layer 190 may also include a kiss cut 192 which extends generally parallel to the longitudinal axis and through a thickness of the protective top layer 190, but not into the adhesive tape layer 170. The kiss cut 192 is convenient for facilitating the removal of the peelable protective top layer 190 from the artificial eyelash adhesive layer 170. The peelable protective top layer 190 may also include a peel tab 194 to also facilitate the removal of the peelable protective top layer 190 (i.e., top layer 190 may be wider and/or longer than underlying adhesive tape layer 170 to provide an overhanging tab that may be easily grasped).

FIG. 2 illustrates another embodiment of an artificial eyelash adhesive dispenser 200 exhibiting two columns of adhesive tape strips, 210, 220, each divided in half by a kiss cut 230, 240, respectively. The artificial eyelash dispenser 200 may include a backing layer having a longitudinal axis 250. The backing layer may also have a perforated gutter 260 also extending generally parallel to the longitudinal axis 250 allowing for ease of separation of the two columns. A layer of an artificial eyelash adhesive tape also may include a bottom surface adjacent to the backing layer. The adhesive tape layer may be fabricated using a double stick low allergic acrylic medical adhesive containing a nonwoven carrier as described above. The adhesive tape layer may be partially cut into a plurality of adjacent adhesive tape strips 270. As described in conjunction with FIG. 1, a peelable protective top layer may overlay the adhesive tape layer to protect the adhesive quality of the tape layer.

Figure 4:
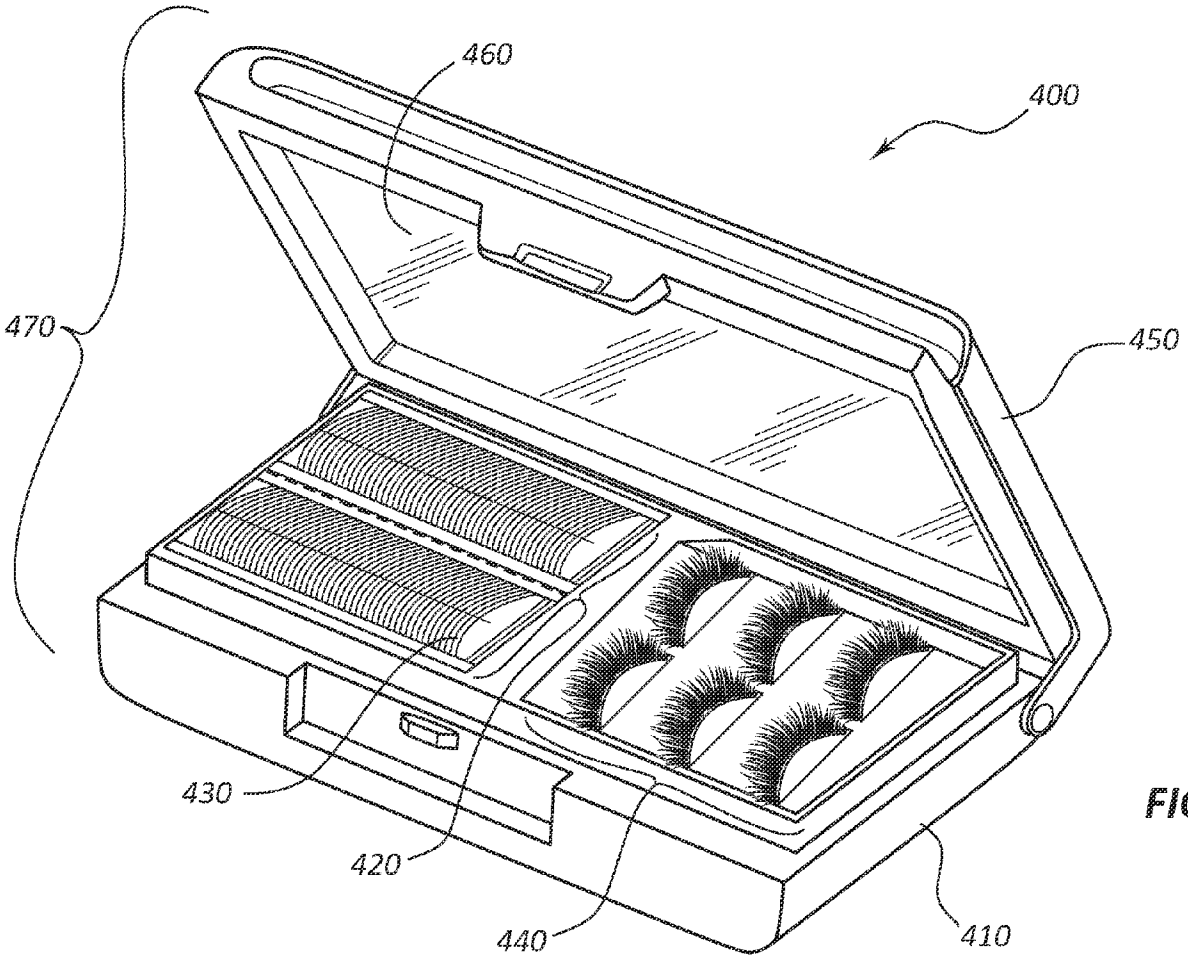
FIG. 4 illustrates an embodiment of an artificial eyelash and adhesive system housed within a personal compact structure.

FIG. 2 illustrates the adhesive tape strips 270 as elongate rectangular shaped, whereas they may be of any shape configured to adhere an artificial eyelash to skin adjacent to a natural lash line. Exemplary dimensions of the components of the artificial eyelash adhesive dispenser 200 are described below. These exemplary dimensions may vary with application, or embodiment. For example, a personal compact artificial eyelash adhesive system as shown in FIG. 4 may use one or two columns of the artificial eyelash adhesive tape strips 210, 220. Further, FIG. 2 may include a strip width dimension of the adhesive tape strip of about 0.0625 in., and a strip length dimension of the strip of about 1.375 inches. The kiss cuts 230, 240 may be positioned midway (0.6875 inch) along the 1.375 inch length of the strip. A gutter of about 0.5 inch may be provided between the columns. The length of both columns together may be about 3.75 inches, and about 1.875 inches from one side edge to axis 250 and gutter 260. The total width or height of the columns may be about 2.5 inches, with a 0.25 inch border at the top, bottom, and sides, so that 32 individual strips are provided in each column. Of course, these dimensions could be larger for application of more than one artificial eyelash structure, or smaller for application of artificial eyelash structures comprised of individual lash structures. Dispenser 200 is illustrated with an adhesive tape layer, identified as "1170". Dispenser 200 may include 32 individual strips per column. Other embodiments may include at least about 5 strips, at least about 10 strips, and less than about 50 strips per column. In one embodiment, the width of individual strips is from about 0.01 inch to about 0.2 inch, from about 0.03 inch to about 0.15 inch, or from about 0.05 inch to about 0.1 inch. In one embodiment, the length of individual strips is from about 1 inch to about 2 inches, from about 1.1 inches to about 1.75 inches, or from about 1.25 inches to about 1.5 inches.

FIG. 2A illustrates a profile view of the artificial eyelash adhesive dispenser 200, shown in FIG. 2. This profile demonstrates the adhesive tape layer between the protective top and bottom liners. These peelable protective top and bottom liners cover both sides of the adhesive tape layer to protect the adhesive quality of the adhesive tape layer.

FIGS. 3A-3G illustrate a method of applying an artificial eyelash adhesive tape layer and an artificial eyelash structure to skin adjacent to a natural lash line of a person's eyelid. The method includes providing an artificial eyelash adhesive tape dispenser, separating an individual adhesive tape strip from the dispenser, peeling the backing layer off of the adhesive strip to expose the bottom surface of the adhesive tape layer, applying the adhesive strip to the natural lash line, peeling the protective top layer from the strip and applying an artificial eyelash structure to the exposed adhesive strip.

Figure 3C:
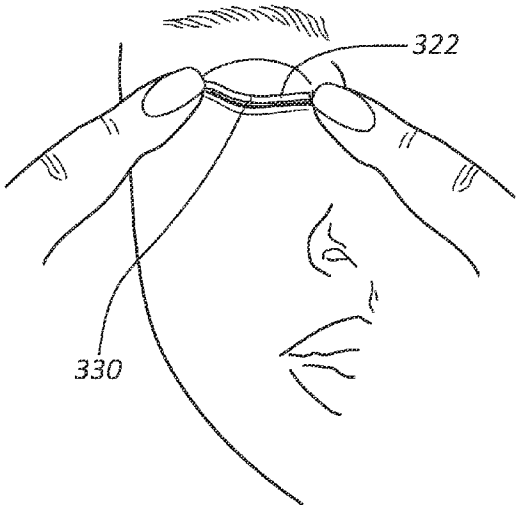
FIG. 3C illustrates applying the exposed adhesive bottom surface of the adhesive tape strip to skin adjacent to a natural lash line of an eyelid.
Figure 3B:
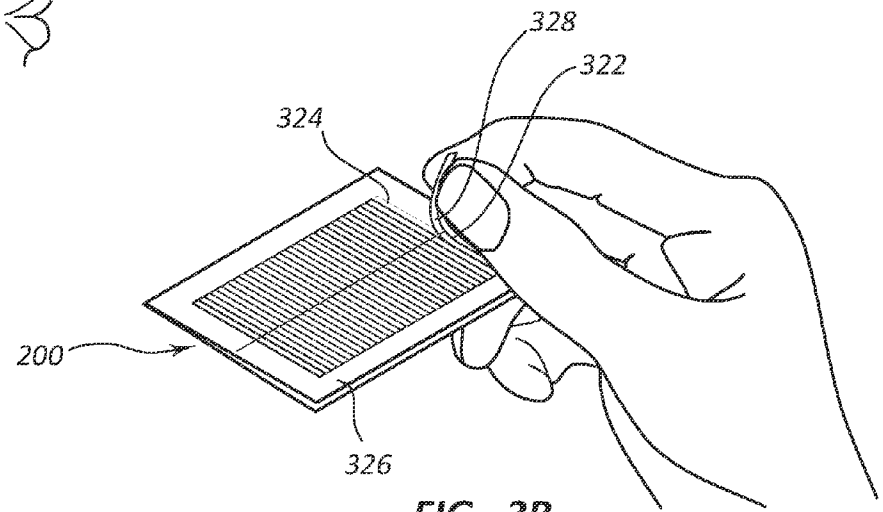
FIG. 3B illustrates an embodiment of an artificial eyelash adhesive tape dispenser from which a user is removing an individual strip.
Figure 3A:
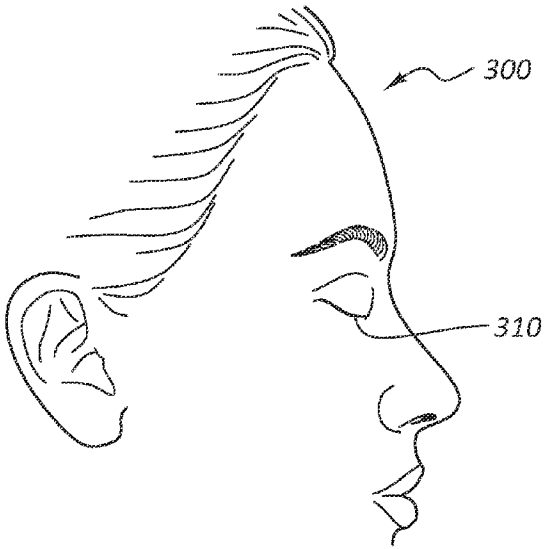
FIG. 3A illustrates a person's natural lash line, along the edge of the eyelid, void of eyelashes.

Person 300, as shown in FIG. 3A, illustrates a person's natural lash line 310, along the edge of the eyelid, void of eyelashes. FIG. 3B illustrates an embodiment of the artificial eyelash adhesive tape dispenser 200 similar to that shown in FIG. 2. FIG. 3B illustrates separating an individual bi-layer or tri-layer strip 322 from the artificial eyelash adhesive tape dispenser 200. In a bi-layer embodiment, separating the individual adhesive tape strip 322 occurs simultaneously with peeling a backing layer 324 off of the adhesive tape strip, as the backing layer 324 may be statically attached to a carrying card or tray 326 (i.e., backing layer 324 is not cut through by the cuts forming individual strips 322). Once removed from the artificial eyelash adhesive tape dispenser 200, a bottom surface of the adhesive tape strip 322 is exposed, while a peelable protective top layer 328 continues to protect an adhesive top surface of the adhesive tape strip 322.

Figure 3D:
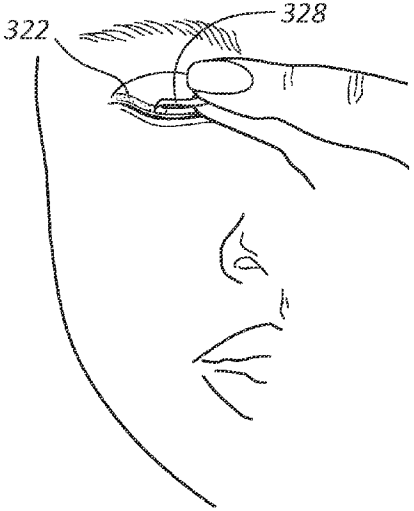
FIG. 3D shows peeling the protective top layer from the adhesive strip placed on the skin adjacent to the natural lash line to expose an adhesive top surface of the adhesive tape strip.
Figure 3E:
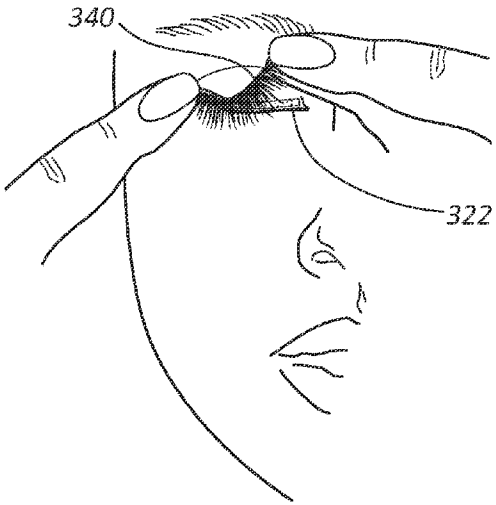
FIG. 3E illustrates application of an artificial eyelash structure to the exposed adhesive top surface of the adhesive tape strip.
Figure 3F:
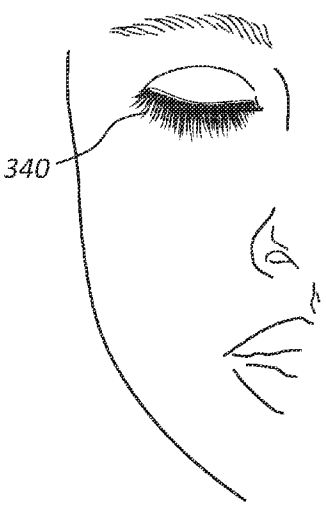
FIG. 3F illustrates the artificial eyelash structure in place, adhered on top of the exposed top surface of the adhesive tape strip.
Figure 3G:
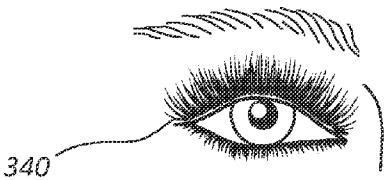
FIG. 3G illustrates the artificial eyelash structure applied to the skin adjacent to a natural lash line that may be secure, physically comfortable, and chemically non-irritating.

FIG. 3C illustrates applying the exposed adhesive bottom surface of the adhesive tape strip 322 to skin adjacent to a natural lash line 330 of an eyelid. As shown in FIG. 3D, the method includes peeling the protective top layer 328 from the adhesive strip 322 placed on the skin adjacent to the natural lash line 330 to expose an adhesive top surface of the adhesive tape strip 322. FIG. 3E illustrates the application of an artificial eyelash structure 340 to the exposed adhesive top surface of the adhesive tape strip 322. FIG. 3F illustrates the artificial eyelash structure 340 in place, adhered on top of the exposed top surface of the adhesive tape strip 322. A dark colored eyeliner may be applied to cosmetically highlight the interface between the artificial eyelash structure 340 and the natural lash line 310. FIG. 3G illustrates the beauty of an artificial eyelash structure 340 applied to the skin adjacent to a natural lash line that may be secure, physically comfortable, and chemically non-irritating.

The adhesive tape layer is the only part of the dispenser that remains in place during use, as both the backing layer and protective top layer are discarded. The adhesive tape layer preferably is very flexible, rather than exhibiting any rigid tendencies. For example, it is preferred to not use tape structures that include a substrate material that is rigid, as this places the rigid substrate material on the eyelid, where its elongate ends can irritate and poke the soft, sensitive tissues surrounding the eyelid. Rather, the adhesive tape layer is thin, preferably transparent or translucent, and very soft and flexible. It may exhibit generally non-rigid "floppy" characteristics, lacking sufficient rigidity to support an elongate horizontal configuration when held at one end under influence of gravity (i.e., the free end will tend to flop down). It may exhibit moleskin type characteristics so as to provide a generally matte (rather than glossy) appearance, through which the skin's natural coloring may show through, and which may also be further disguised through use of eyeliner or other makeup, as described.

In another embodiment, the backing layer 324 may be partially cut, along with the tape layer and protective top layer 328 to facilitate removal of a tri-layer adhesive tape strip 322 from the artificial eyelash adhesive tape dispenser 100, with both the backing layer 324 and the peelable protective top layer 328 intact and attached to the adhesive tape strip 322. In this embodiment, the backing layer 324 may be peeled off to expose an adhesive bottom surface that subsequently is applied to skin adjacent to the natural lash line 310. Kiss cuts are particularly helpful in removing backing layer 324 as well as protective top layer 328. Once the adhesive bottom surface is placed on the eyelid, the peelable protective top layer 328 may be removed exposing the adhesive top surface for application of the artificial eyelash structure 340. In a related embodiment, following the removal of the adhesive tape strip 322 from the artificial eyelash adhesive tape dispenser 100 (with the backing layer 324 and the peelable protective top layer 328 intact, covering the adhesive layer) the peelable protective top layer 328 may be removed from the adhesive tape strip 322 exposing the adhesive top surface. The adhesive top surface may be applied to skin adjacent to the natural lash line 310, followed by removal of the backing layer 324 and application of the artificial eyelash structure 340.

In yet another embodiment, the peelable protective top layer 328 may be removed from the artificial eyelash adhesive tape layer via a peel tab 194, or a kiss cut 192 as shown in FIG. 1, before the adhesive tape strip 322 is removed from the artificial eyelash adhesive tape dispenser 100. In this embodiment, the backing layer 324 may remain attached to a carrying card, tray 410, personal compact 400 (as shown in FIG. 4) or other substrate resulting in both an exposed adhesive top and bottom surface of the adhesive strip 322. Further, in this embodiment, because the adhesive tape strips 322 are adhesive on both sides, the exposed adhesive tape top or bottom surface may first be applied to the skin adjacent to the natural lash line 310, allowing for application of the artificial eyelash structure 340 to the remaining exposed adhesive tape surface.

FIG. 4 illustrates an embodiment of an artificial eyelash and adhesive system 400. In this embodiment, the artificial eyelash and adhesive system 400 is housed within a personal compact structure 470. The personal compact structure 470 includes a bottom tray 410 including an artificial eyelash adhesive tape dispenser 420, similar to the artificial eyelash adhesive tape dispenser 100 shown in FIG. 1. The artificial eyelash and adhesive system also includes a plurality of artificial eyelash adhesive tape strips 430, and one or more artificial eyelash structures 440. The personal compact structure 470 also includes a lid structure 450 hinged to the bottom tray 410. The personal compact structure 470 includes a personal minor 460 for convenient adhesive tape strip 430 and artificial eyelash structure 440 application. The personal compact may be closed to protect the artificial eyelash and adhesive system 400, and its diminutive size allows for convenience and portability. While a rectangular compact 400 is shown, it will be understood that other shapes are also possible (e.g., circular).

Figure 5:
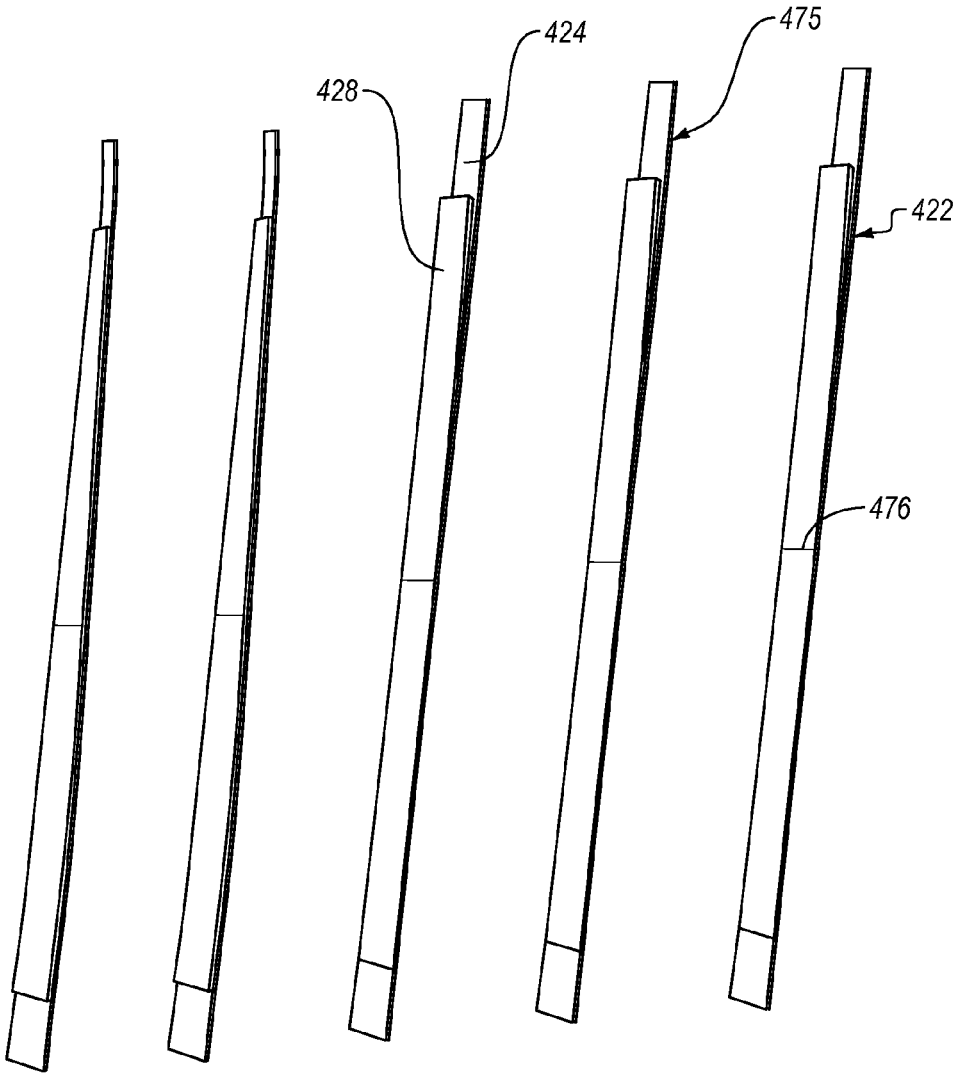
FIG. 5 illustrates a plurality of separated individual artificial eyelash adhesive tri-layer structures.

In one embodiment, individual tri-layer strips 475 including a backing layer 424, a protective top layer 428, and an artificial eyelash adhesive tape layer 422 sandwiched therebetween may be provided. A plurality of such tri-layer strips is shown in FIG. 5. As with other embodiments, one or both of backing layer 424 and protective top layer 428 may include a kiss-cut 476 therethrough to facilitate removal of the corresponding protective layer at the time of placement of the artificial eyelash adhesive tape layer 422 along the natural lash line.

Figure 6:
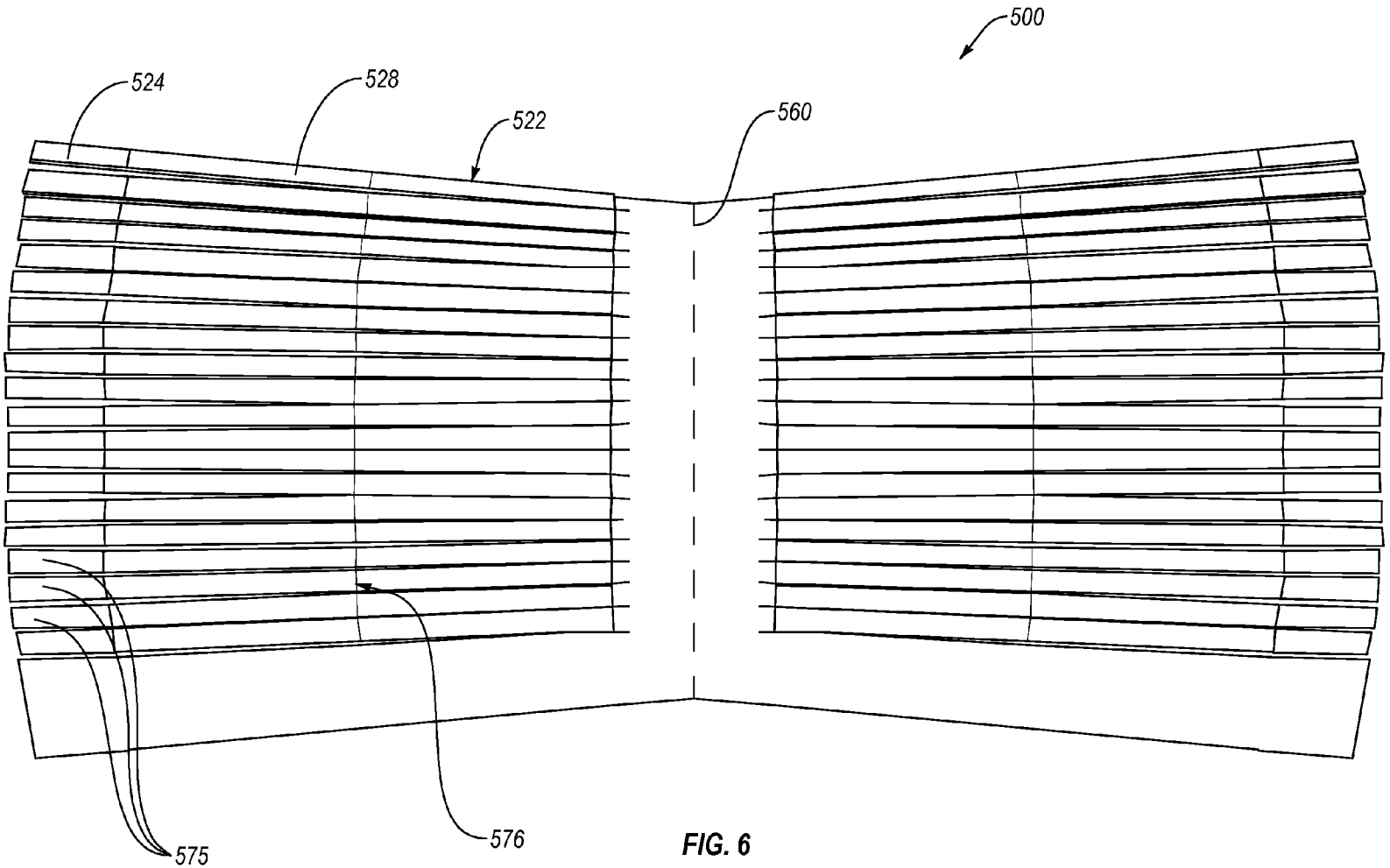
FIG. 6 illustrates another embodiment of an artificial eyelash adhesive dispenser in a fanned configuration.

FIG. 6 shows another embodiment of a fanned dispenser 500 that is similar to dispenser 200 of FIG. 2, but in which individual strips 575 are connected to the center portion of dispenser 500 adjacent axis and discontinuous die cut or perforated gutter 560. The other 3 perimeter sides of each rectangular individual strip structure 575 are completely cut so as to be separate from adjacent strip structures. The 0.25 inch side border of FIG. 2 in instead cut through to the edge in the FIG. 5 embodiment. Each strip structure 575 may include a backing layer 524 and a protective top layer 528, with the adhesive tape layer 522 sandwiched therebetween. A kiss cut 576 may be provided. In some embodiments, one of top protective layer 528 or backing layer 524 may be longer than the other to more easily facilitate gripping and removal of the layer, when desired.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of applying an artificial eyelash adhesive tape layer and artificial eyelash structure to a natural lash line of a person, the method comprising:

providing an artificial eyelash adhesive dispenser comprising;

a backing layer having a longitudinal axis;

an artificial eyelash adhesive tape layer having a bottom surface adjacent to the backing layer and also having an opposing top surface; and a peelable protective top layer over the top surface of the false eyelash adhesive tape layer;

at least the adhesive tape layer and peelable protective top layer including a plurality of cuts extending a portion of a width of the dispenser in a direction oriented generally transverse to the longitudinal axis of the backing layer so as to form a tear line along which an individual strip including at least a portion of the adhesive tape layer and a portion of the peelable protective top layer may be separated from a remainder of the dispenser;

separating an individual strip comprising a portion of at least the artificial eyelash adhesive tape layer and a portion of the peelable top layer from the dispenser;

exposing the bottom surface of the adhesive tape layer of the strip;

applying the bottom surface of the adhesive tape layer of the strip to skin adjacent to a natural lash line;

peeling the protective top layer from the strip; and applying an artificial eyelash structure to an exposed top surface of the strip.

2. The method of claim 1 wherein each strip is curved.

3. The method of claim 1 wherein each strip is generally rectangularly shaped.

4. The method of claim 1 wherein the protective top layer includes a kiss cut which extends generally parallel to the longitudinal axis and through a thickness of the top layer, but not into the adhesive tape layer to facilitate removal of the top layer.

5. The method of claim 1 wherein the plurality of cuts also extend through the backing layer so that a tri-layer strip comprising a portion of the backing layer, a portion of the adhesive tape layer, and a portion of the peelable top layer may be separated from the dispenser along the tear line.

6. The method of claim 5 wherein the backing layer includes a kiss cut which extends generally parallel to the longitudinal axis of the backing layer and through a thickness of the backing layer, but not into the adhesive tape layer to facilitate removal of the backing layer.

7. The method of claim 1 wherein the plurality of cuts do not extend through the backing layer so that a bi-layer strip comprising a portion of the adhesive tape layer and a portion of the peelable top layer may be separated from the dispenser along the tear line.

8. The method of claim 1 wherein the dispenser includes two generally parallel columns of strips positioned side-by-side, further comprising a perforated gutter between the two columns.

9. The method of claim 1 wherein one of the backing layer or peelable protective top layer is longer than the other.

10. The method of claim 1 wherein each strip is attached to a remainder of the dispenser at only one side, the other sides being disconnected from the remainder of the dispenser so as to present a fanned configuration.

11. The method of claim 1 wherein the adhesive tape layer is an acrylic based wig tape adhesive so as to not irritate contacted tissue when in contact therewith for at least about 8 hours.

12. The method of claim 1 wherein the elongate artificial eyelash adhesive tape layer does not include any rigid structure, but is flexible and soft so that an end of the elongate artificial eyelash adhesive tape layer does not poke or otherwise irritate the user's eyelid and adjacent tissue.

13. The method of claim 1 wherein the bottom surface of the adhesive tape layer of the strip is applied to skin adjacent to a natural lash line before peeling the protective top layer from the strip.

14. The method of claim 1 wherein separating the individual strip occurs simultaneously with peeling the backing layer off of the individual strip so as to expose the bottom surface of the adhesive tape layer of the strip.

15. The method of claim 1 further comprising applying an eyeliner to an interface between the artificial eyelash structure and the natural lash line.

16. The method of claim 1 wherein each of the plurality of cuts through the adhesive tape layer comprises a discontinuous cut through the adhesive tape layer to facilitate removal of an individual strip when desired.

* * * * *